US007121335B2

(12) United States Patent
Townsend

(10) Patent No.: US 7,121,335 B2
(45) Date of Patent: Oct. 17, 2006

(54) PLUNGER FOR GAS WELLS

(75) Inventor: Murray Ray Townsend, Lindale (CA)

(73) Assignee: Fourth Dimension Designs Ltd., Edmonton (CA)

( * ) Notice: Subject to any disclaimer, the term of this patent is extended or adjusted under 35 U.S.C. 154(b) by 106 days.

(21) Appl. No.: 10/833,654

(22) Filed: Apr. 28, 2004

(65) Prior Publication Data

US 2004/0226713 A1 Nov. 18, 2004

(30) Foreign Application Priority Data

May 13, 2003 (CA) ..... 2428618

(51) Int. Cl.
*E21B 43/00* (2006.01)

(52) U.S. Cl. ..... 166/105; 166/53

(58) Field of Classification Search ..... 166/101, 166/53, 105, 153, 332.1, 372, 334.1; 417/56, 417/555.2

See application file for complete search history.

(56) References Cited

U.S. PATENT DOCUMENTS 2,661,024 A 12/1953 Knox
3,055,306 A * 9/1962 Tausch ..... 417/60
3,181,470 A * 5/1965 Clingman ..... 417/56
4,239,458 A * 12/1980 Yeatts ..... 417/60
4,502,843 A * 3/1985 Martin ..... 417/56
4,629,004 A * 12/1986 Griffin ..... 166/372
6,148,923 A * 11/2000 Casey ..... 166/372
6,200,103 B1 * 3/2001 Bender ..... 417/56
6,644,399 B1 * 11/2003 Abbott et al. ..... 166/68
6,725,916 B1 * 4/2004 Gray et al. ..... 166/68.5

* cited by examiner

*Primary Examiner*—David Bagnell
*Assistant Examiner*—Daniel P. Stephenson
(74) *Attorney, Agent, or Firm*—Davis & Bujold, P.L.L.C.

(57) ABSTRACT

A plunger for a gas well including an elongate body having a first end and a second end. A sleeve overlying the body. The sleeve being shorter in length than the elongate body and is axially moveable between the first end and the second end of the body. At least one circumferential seal on the exterior surface of the sleeve, thereby providing a barrier to the passage of fluids along the exterior surface of the sleeve. At least one fluid flow passage is provided through the sleeve. A first axial stop is provided at the first end of the body and a second axial stop is provided at the second end of the body to limit axial movement of the sleeve. The second axial stop having sealing shoulders which engage the second end of the sleeve to close off the at least one fluid flow passage.

4 Claims, 4 Drawing Sheets

PLUNGER FOR GAS WELLS

FIELD OF THE INVENTION

The present invention relates to a plunger for gas wells

BACKGROUND OF THE INVENTION

U.S. Pat. No. 2,661,024 (Knox 1953) is representative of a style of plunger which has been used in gas wells for the last 50 years. The plunger has a tubular body with an exterior surface and an interior flow passage. A number of seals encircle the exterior surface to prevent fluid from passing along the exterior surface of the plunger. A valve member is positioned at the end of the tubular body. The valve member moves axially along the interior flow passage toward a valve seat. The valve has an open position and a closed position. In the open position, the valve is spaced from the valve seat allowing a free flow of fluids along the interior flow passage. In the closed position, the valve member engages the valve seat to prevent fluids from entering the interior flow passage. The valve has a stem which protrudes past an end of the tubular body. When the plunger reaches its receiver at a bottom of the gas well, this stem strikes the receiver and the valve is pushed from the open position to the closed position. When the valve member is closed, gas pressure building below the plunger causes the plunger to rise in the tubing. As the plunger rises, it pushes ahead of it accumulated liquids. Upon reaching the surface, the valve member is moved to the open position by striking the stem which permits gas to pass through the plunger. The plunger valve then descend back into the well, with gas passing through the interior flow passage of the plunger. Upon reaching the bottom of the well, the valve member is moved to the closed position so that gas pressure is allowed to build up again below the plunger.

SUMMARY OF THE INVENTION

What is required is an alternative form of plunger for gas wells.

According to the present invention there is provided a plunger for a gas well which includes an elongate body having a first end and a second end. A sleeve overlies the body. The sleeve has a first end, a second end, an exterior surface and an interior bore. The sleeve is shorter in length than the elongate body and is axially moveable between the first end and the second end of the body. At least one circumferential seal is provided on the exterior surface of the sleeve, thereby providing a barrier to the passage of fluids along the exterior surface of the sleeve. At least one fluid flow passage is provided through the sleeve. A first axial stop is provided at the first end of the body that engages the first end of the sleeve to limit axial movement of the sleeve in a first direction. A second axial stop is provided at the second end of the body that engages the second end of the sleeve to limit axial movement of the sleeve in a second direction. The second axial stop has sealing shoulders which engage the second end of the sleeve to close off the at least one fluid flow passage.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
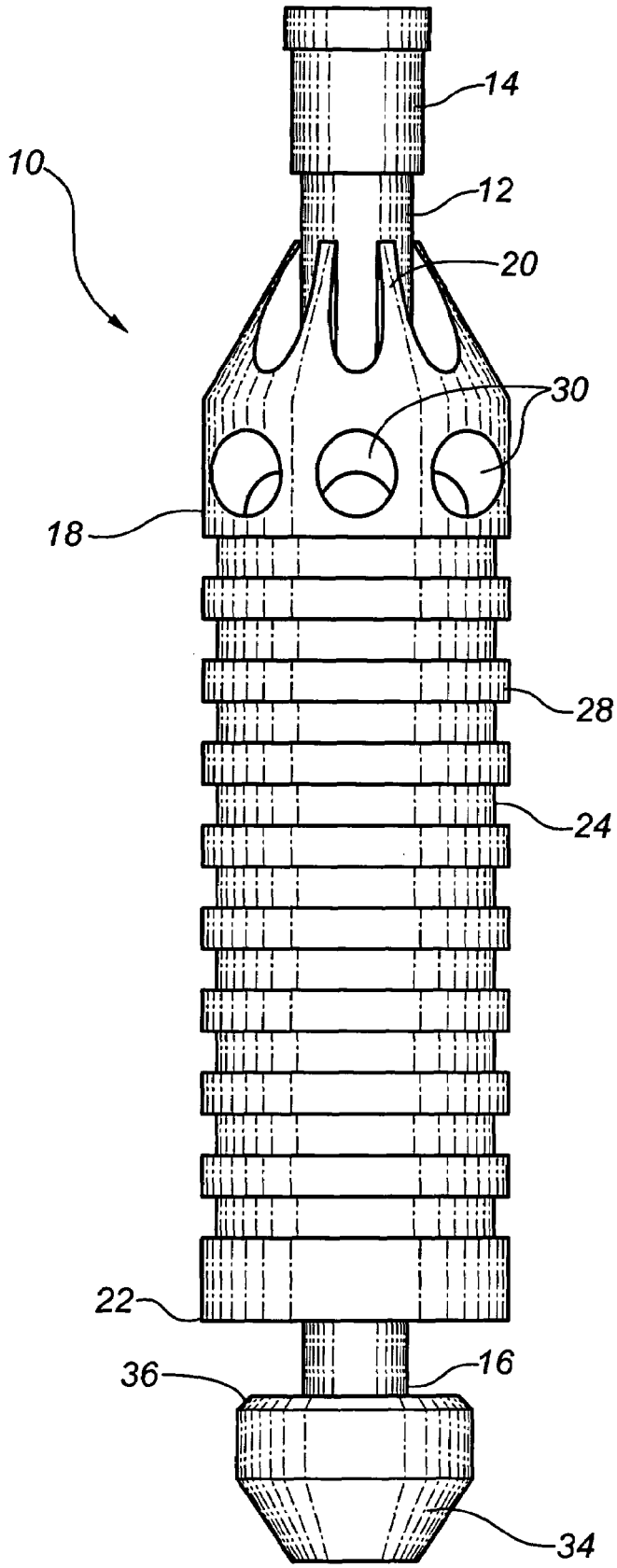
FIG. 1 is a side elevation view of a plunger for plunger gas lift system constructed according to the teachings of the present invention.

The preferred embodiment, a plunger for a gas well, generally identified by reference numeral 10, will now be described with reference to FIGS. 1 through 5.

Figure 2:
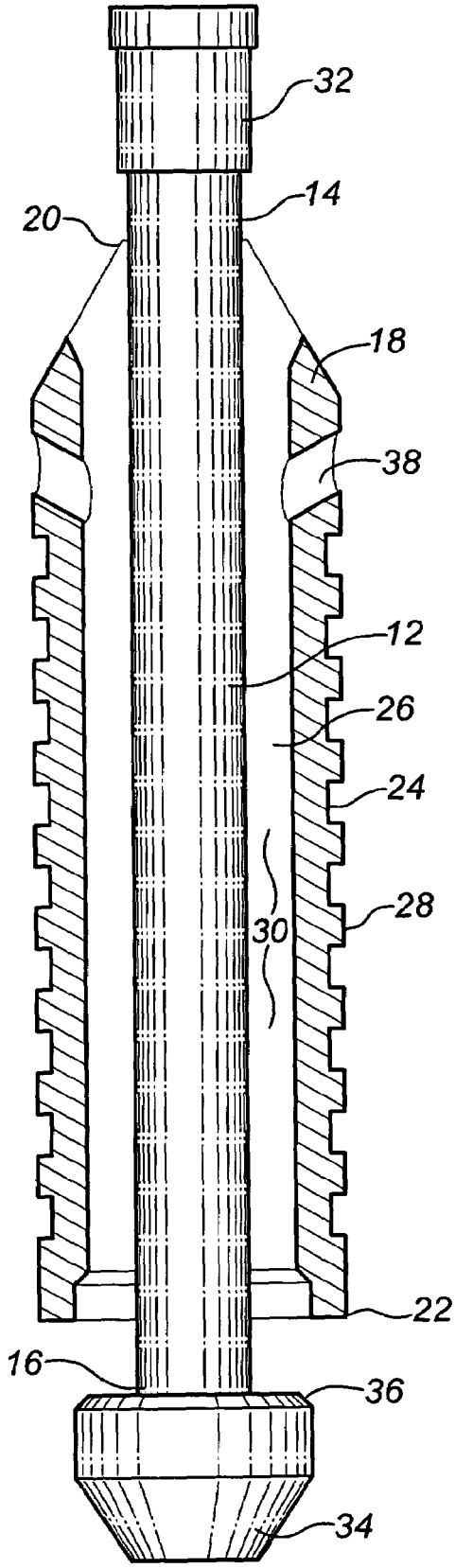
FIG. 2 is a side elevation view, in section, of the plunger illustrated in FIG. 1.

Structure and Relationship of Parts:

Referring to FIG. 1, there is provided a plunger 10 for a gas well which includes an elongate body 12 that has a first end 14 and a second end 16. A sleeve 18 is provided that overlies body 12. Referring to FIG. 2, sleeve 18 has a first end 20, a second end 22, an exterior surface 24 and an interior bore 26. Sleeve 18 is shorter in length than elongate body 12. Sleeve 18 is axially moveable between first end 14 and second end 16 of body 12.

Figure 5:
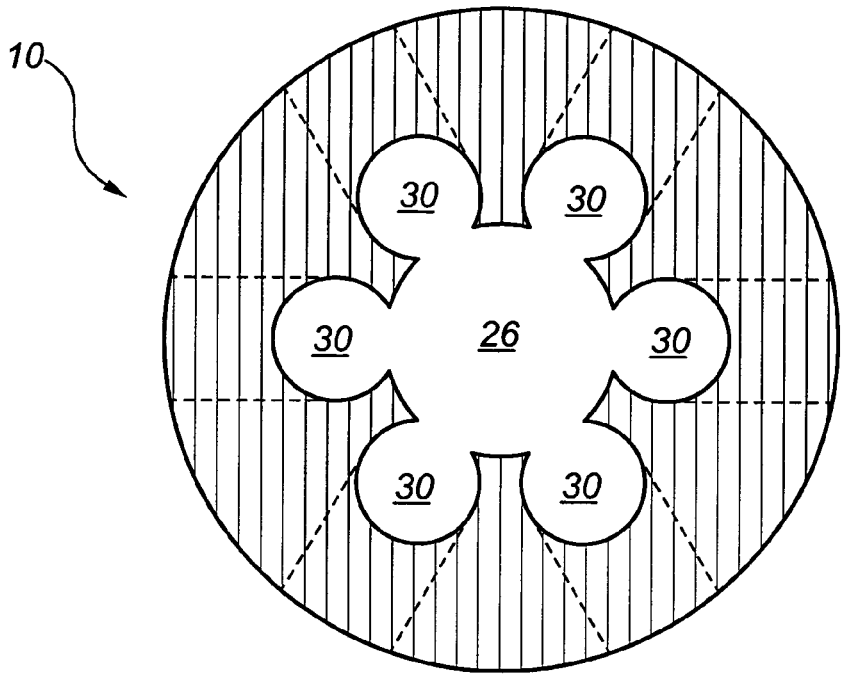
FIG. 5 is a top plan view, in section, of the sleeve of the plunger illustrated in FIG. 1.

Referring to FIG. 1, a circumferential seal in the form of spaced seal rings 28 is provided on exterior surface 24 of sleeve 18, thereby providing a barrier to the passage of fluids along exterior surface 24 of sleeve 18. Referring to FIG. 5, several fluid flow passages are provided through sleeve including flow passage 30. Although several fluid flow passages are illustrated, it will be appreciated that there could also be only one annular fluid flow passage 30.

Referring to FIG. 1, a first axial stop 32 is provided at first end 14 of body 12 that engages first end 20 of sleeve 18 to limit axial movement of sleeve 18. A second axial stop 34 is provided at second end 16 of body that engages second end 22 of sleeve 18 to limit axial movement of sleeve 18. Second axial stop 34 has sealing shoulders 36 which engage second end 22 of sleeve 18 to elongate body 12.

Referring to FIG. 2, screws 37 can be placed in flow passages adjacent first end 20 of sleeve 18 to selectively for close off one or more of flow passages 30.

Figure 3:
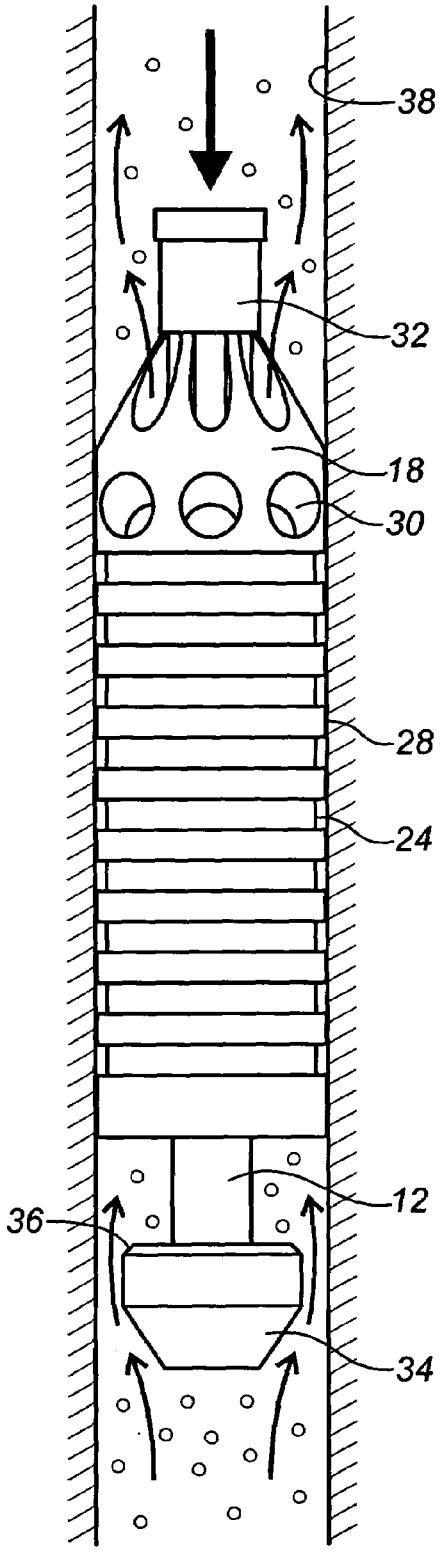
FIG. 3 is a side elevation view, in section, of the plunger descending in a gas well.
Figure 4:
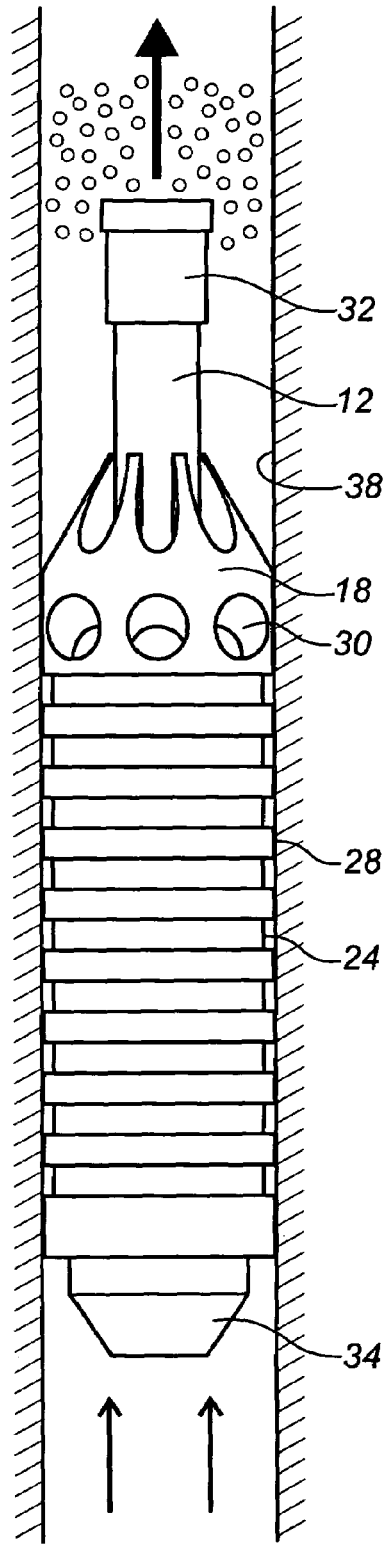
FIG. 4 is a side elevation view, in section, of the plunger rising in a gas well.

Operation:

Referring to FIG. 3, plunger 10 is placed in a gas well 38. As plunger 10 descends in gas well 38, circumferential seal 28 provided on exterior surface 24 of sleeve 18 provides a barrier to passage of fluids along exterior surface 24 of sleeve 18. Referring to FIG. 2, fluids are forced to pass through fluid flow passage 30. Referring to FIG. 4, when plunger 10 reaches a bottom of gas well 38, body 12 stops moving and gravity moves sleeve 18 toward second axial stop 34 that is provided at second end 16 of body 12 to limit axial movement of sleeve 18. Sealing shoulders 36 of second axial stop 34 engage second end 22 of sleeve 18 to close off fluid flow passage 30. Referring to FIG. 3, when fluids aren't permitted to pass, pressure from fluids building beneath plunger 10 causes plunger 10 to begin to rise in gas well 38. As the rising plunger 10 reaches the top of gas well 38, body 12 stops moving and the flow of fluid through gas well 38 continues to move sleeve 18 axially upward along body 12 away from second axial stop 34 and toward first axial stop 32. As second axial stop 34 is no longer closing fluid flow passage 30, fluids are permitted to pass through fluid flow passage 30. Referring to FIG. 4, plunger 10 then begins to descend again within gas well 38.

Referring to FIG. 3, the speed at which plunger 10 descends in gas well 38 can be adjusted by using screws 37 to selectively close off one or more of flow passages 30, as illustrated in FIG. 2. Referring to FIG. 3, if all flow passages 30 remain open, plunger 10 will descend more rapidly through gas well 38 as more fluid is allowed to pass through plunger. If a slower decent is desirable, one or more of flow passages 30 can be closed off with screws 37, so that it takes longer for fluid to pass through plunger 10, thereby slowing the travel of plunger 10 in the gas well 38.

Advantages:

There are several advantages to the use of plunger 10 over those of in the prior art. Unlike plunger systems in the prior art, with plunger 10, the gas well 38 does not need to be shut in order for plunger 10 to operate. Plunger 10 rises and falls in a continuous cycle within gas well 38. Another advantage with plunger 10 is that body 12 does not need to strike anything in order for body 12 or sleeve 18 to move to open or close off fluid flow passages 30. As plunger 10 reaches the top of gas well 38, body 12 stops moving and the flow of fluid through gas well 38 continues to move sleeve 18 axially upward along body 12 away from second axial stop 34 and toward first axial stop 32. As second axial stop 34 is no longer closing fluid flow passage 30, fluids are permitted to pass through fluid flow passage 30 allowing plunger to travel downward in gas well 38. When plunger 10 reaches a bottom of gas well 38, body 12 stops moving, and gravity moves sleeve 18 toward second axial stop 34 so that sealing shoulders 36 of second axial stop 34 engage second end 22 of sleeve 18 to close off fluid flow passage 30. Another advantage is that closer tolerances are permitted.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The invention claimed is:

1. A plunger for a gas well, comprising:

an elongate body having a first end and a second end;

a sleeve overlying the body, the sleeve having a first end, a second end, an exterior surface and in interior bore, the sleeve being shorter in length than the elongate body, the sleeve being free to move axially along the elongate body unfettered between the first end and the second end of the body;

at least one circumferential seal on the exterior surface of the sleeve, thereby providing a barrier to the passage of fluids along the exterior surface of the sleeve;

at least one fluid flow passage through the sleeve;

a first axial stop at the first end of the body that engages the first end of the sleeve to limit axial movement of the sleeve; and a second axial stop at the second end of the body that engages the second end of the sleeve to limit axial movement of the sleeve, the second axial stop having sealing shoulders which engage the second end of the sleeve to close off the at least one fluid flow passage.

2. The plunger as claimed in claim 1, wherein there is more than one fluid flow passage through the sleeve.

3. The plunger valve as defined in claim 1, wherein there is more than one circumferential seal on the exterior surface of the sleeve, in the form of parallel spaced seal rings.

4. A plunger for a gas well, comprising an elongate body having a first end and a second end;

a sleeve overlying the body, the sleeve having a first end, a second end, an exterior surface and an interior bore, the sleeve being shorter in length than the elongate body, the sleeve being free to move axially along the elongate body unfettered between the first end and the second end of the body;

at least one circumferential seal on the exterior surface of the sleeve, thereby providing a barrier to passage of fluids along the exterior surface for the sleeve;

one or more fluid flow passages through the sleeve;

a first axial stop at the first end of the body that engages the first end of the sleeve to limit axial movement of the sleeve; and a second axial stop at the second end of the body that engages the second end of the sleeve to limit axial movement of the sleeve, the second axial stop having sealing shoulders which engage the second end of the sleeve to close off the one or more fluid passages; and a means being provided for selectively closing one or more of the fluid flow passages.

* * * * *